US007011283B2

(12) United States Patent
Lemire

(10) Patent No.: US 7,011,283 B2
(45) Date of Patent: Mar. 14, 2006

(54) HOOK AND CORD LOOP HANGING SYSTEM

(76) Inventor: Robert J. Lemire, P.O. Box 299, Kings Park, NY (US) 11754

( * ) Notice: Subject to any disclaimer, the term of this patent is extended or adjusted under 35 U.S.C. 154(b) by 0 days.

(21) Appl. No.: 10/806,017

(22) Filed: Mar. 23, 2004

(65) Prior Publication Data

US 2005/0211865 A1 Sep. 29, 2005

(51) Int. Cl.
*A47G 1/24* (2006.01)

(52) U.S. Cl. ..... 248/476; 248/495

(58) Field of Classification Search ..... 248/476, 248/480, 493, 495, 475.1
See application file for complete search history.

(56) References Cited

U.S. PATENT DOCUMENTS 3,251,569 A * 5/1966 Rynearson ..... 248/493
3,788,588 A * 1/1974 Tendler ..... 248/467
4,863,135 A * 9/1989 Mellor et al. ..... 248/328
4,892,284 A * 1/1990 Kelrick ..... 248/476
5,806,826 A * 9/1998 Lemire ..... 248/476
5,931,439 A * 8/1999 Lemire ..... 248/493
5,947,438 A * 9/1999 Lemire ..... 248/476
6,062,525 A * 5/2000 Lemire ..... 248/475.1
6,334,602 B1 * 1/2002 Clarke ..... 248/495
6,405,466 B1 * 6/2002 Lemire ..... 40/757

* cited by examiner

*Primary Examiner*—Kimberly Wood
*Assistant Examiner*—Amy J. Sterling

(57) ABSTRACT

Objects hung with the improved hook & cord loop hanging system uses one or more adjustable hooks for changing the length of one or more flexible cord loops. This hanging system is an improvement over the hangers described in U.S. Pat. No. 5,947,438. Each improved hanger can either be affixed to the object or to the surface the object is being hung on. The cord loop or loops interface with various supports connecting to or affixed to the object or to the surface when the hanger is on the object. The single hook and single cord configuration provides vertical adjustability by shortening the length of the cord through the turning of the screw the adjustable hook is ridding on. A single hook and double cord configuration provides support and locking for the object. A double hook and double cord configuration provides vertical ajdustability and locking capability These hangers can be used alone for small objects or in pairs for larger or heavier objects.

7 Claims, 4 Drawing Sheets

HOOK AND CORD LOOP HANGING SYSTEM

FIELD OF THE INVENTION

This invention generally relates to objects hung on a surface, such as pictures, mirrors, plaques, etc.

BACKGROUND OF THE INVENTION

This application is an improvement to U.S. Pat. No. 5,947,438. FIG. #1 in U.S. Pat. No. 5,947,438 shows adjustable hooks 14AA and 14BA with cord 116 hanging down and hook 118 fastened to the end of it. The improvements cited in this application deal with the number and configurations of the hooks and cords shown in that drawing. Some may consider the improvements to be obvious; however, this application is considered to provide significant new matter that is not covered by that patent.

SUMMARY OF THE INVENTION

It is the object of the present invention to provide useful means for hanging objects with adjustable cord loops for positioning and locking objects onto a surface.

The first item is the use of a cord loop formed by extending the cord from one side of the hanger to the other. By having an adjustable loop the hanger can then interface with a number of different brackets for supporting an object. An "S" type hook can be used on the cord loop, or a bracket can be affixed to the object so that the bracket or hook from the object hangs on the loop from the hanger. The head of one or more protruding screws can also be used to support the object. Furthermore, the bracket can interface with the body of the hanger so that the object is locked onto the hanger.

The second item is the use of two cords forming a top and a bottom loop with a common adjusting hook in the hanger body. With this arrangement the object can be locked onto the surface when the loops are tightened against a double wall bracket or top and bottom hooks on the object when the hanger is affixed to the wall.

The third item is the use of two cords forming top and bottom loops with top and bottom adjusting hooks in the hanger body. With this arrangement the object can be positioned vertically to a desired level by the supporting loop and then locked into place by tightening the second loop. When the hanger is affixed to a wall the lower loop is the support loop and the top loop provides a range of top tilting until the loop is drawn tight and the object becomes locked onto the hanger.

DETAILED DESCRIPTION

Figure 1:
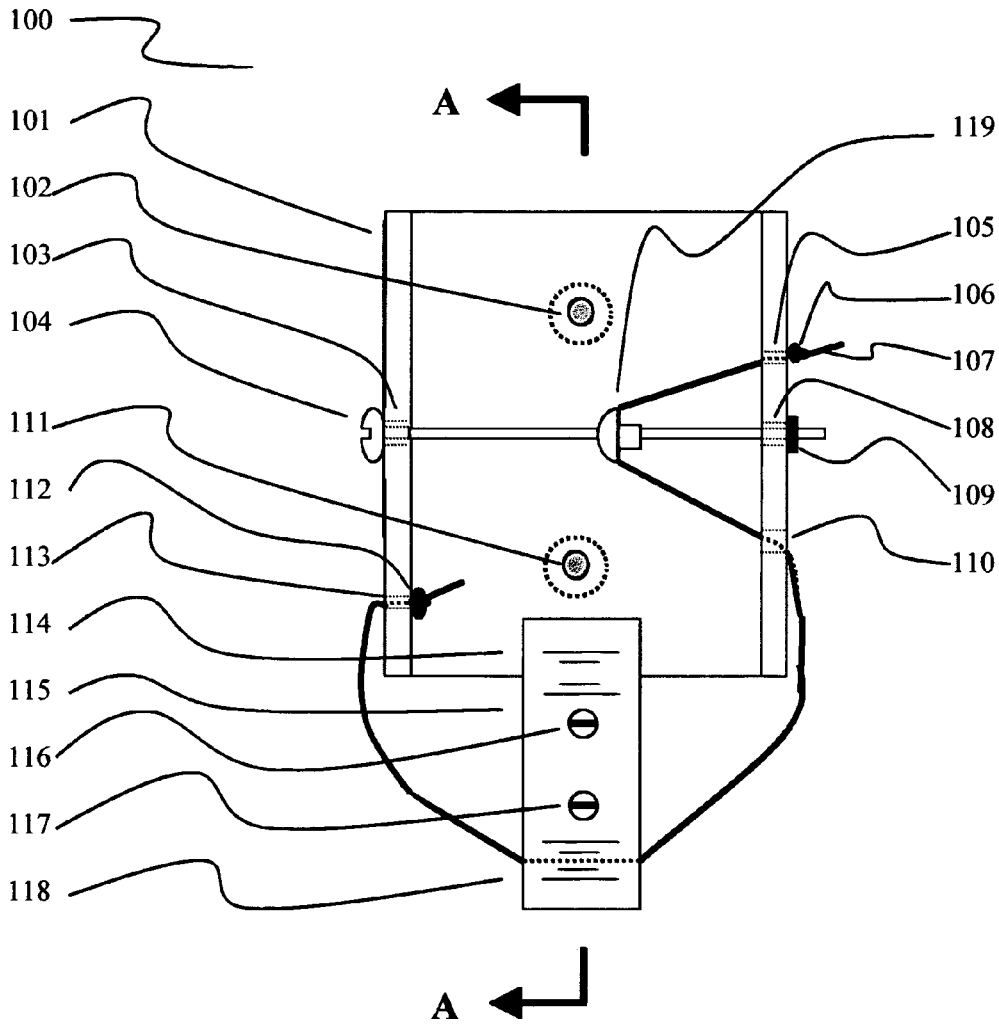
FIG. 1 is a back elevational view from the wall surface of a single loop hanger with a single adjusting hook fastened to a wall and a double beveled bracket fastened to an object.

Firstly, referring to FIG. 1 which is a back elevational view looking away from the wall of hanger 100 assembly 100. The hanger body 101 is affixed to wall surface by screws 102 and 111. The body 101 has apertures 103 and 108 through which screw 104 is going. Screw 104 has hook 119 threadably engaged to it and is secured in position by retainer 109. Cord 107 has knot 106 keeping it secured to the hanger body at aperture 105. The cord extends from aperture 105 to hook 119 then over to aperture 110 and forms a V-shape. The cord exits the hanger body at 110 and extends down to space 118 formed by bracket 115 and continues around to the other side of the hanger body 101 where it enters aperture 113 and has knot 112 securing it to the hanger. Bracket 115 is affixed to an object with screws 116 and 117. Bracket 115 is configured to have beveled areas 114 and 118. Beveled area 118 allows the object to be hung on cord 107 while beveled area 114 engages the hanger body 101.

When an bracket 115 is hung on the cord extending down from the bottom of hanger body 101 it can be raised up by the action of the screw 104 and hook 119 pulling on cord 107 and making the V-shaped section of cord longer. As the bracket 115 moves up the upper beveled area 114 engages the hanger body 101 and effectively locks the object onto the hanger.

Figure 2:
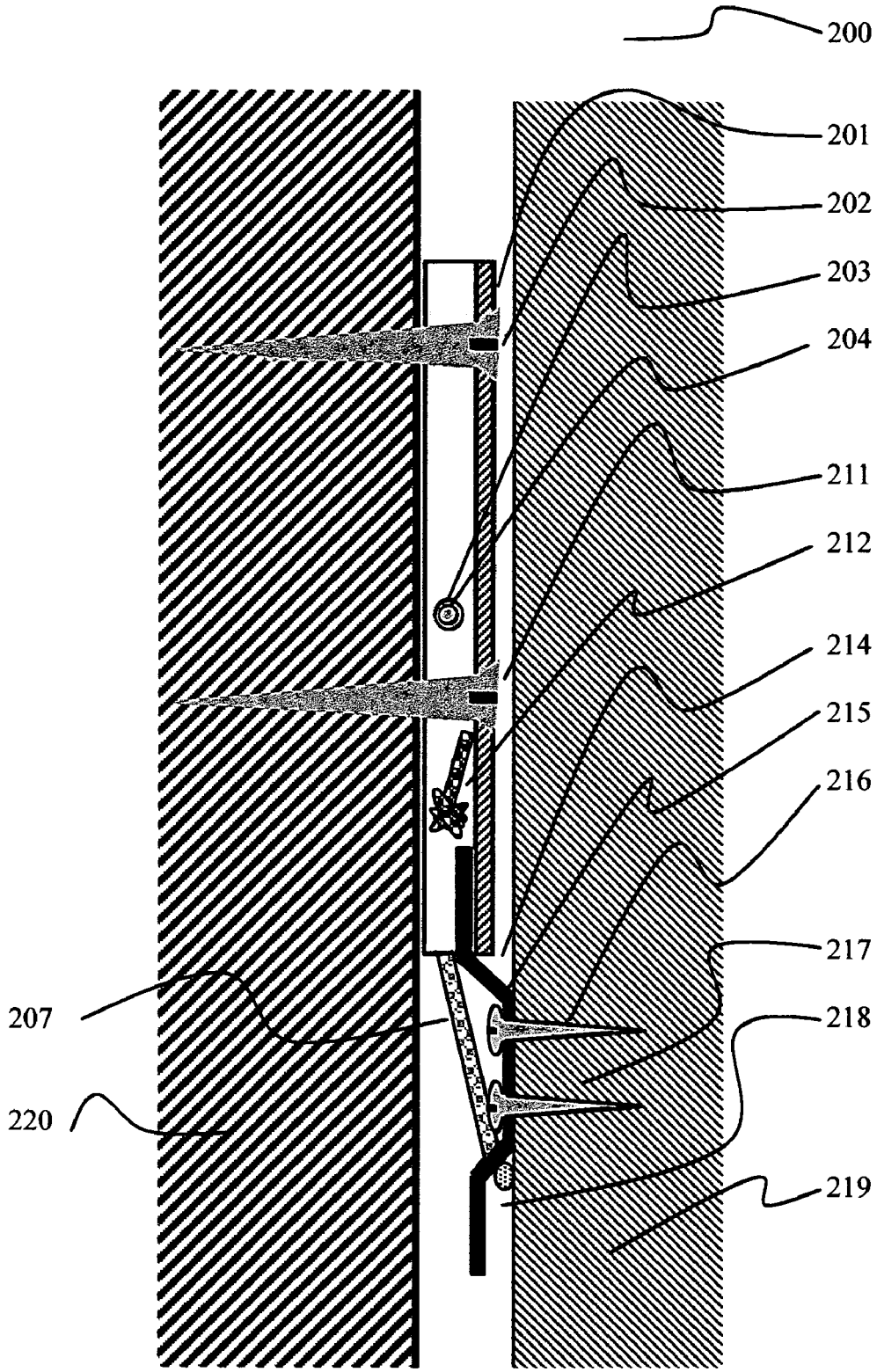
FIG. 2 is section A—A from FIG. 1.

FIG. 2 is section A—A of FIG. 1. It shows hanger body 201 affixed to wall 220 with screws 202 and 211. Screw 204 is going through aperture 203. Cord 207 is knotted at 212 and extends down into area 218 formed between bracket 215 and object 219. Bracket 215 is affixed to object 219 with screws 216 and 217. Bracket 215 has area 214 engaging hanger body 201 in space 214. This drawing shows the object being held and locked onto the hanger assembly 200.

Figure 3:
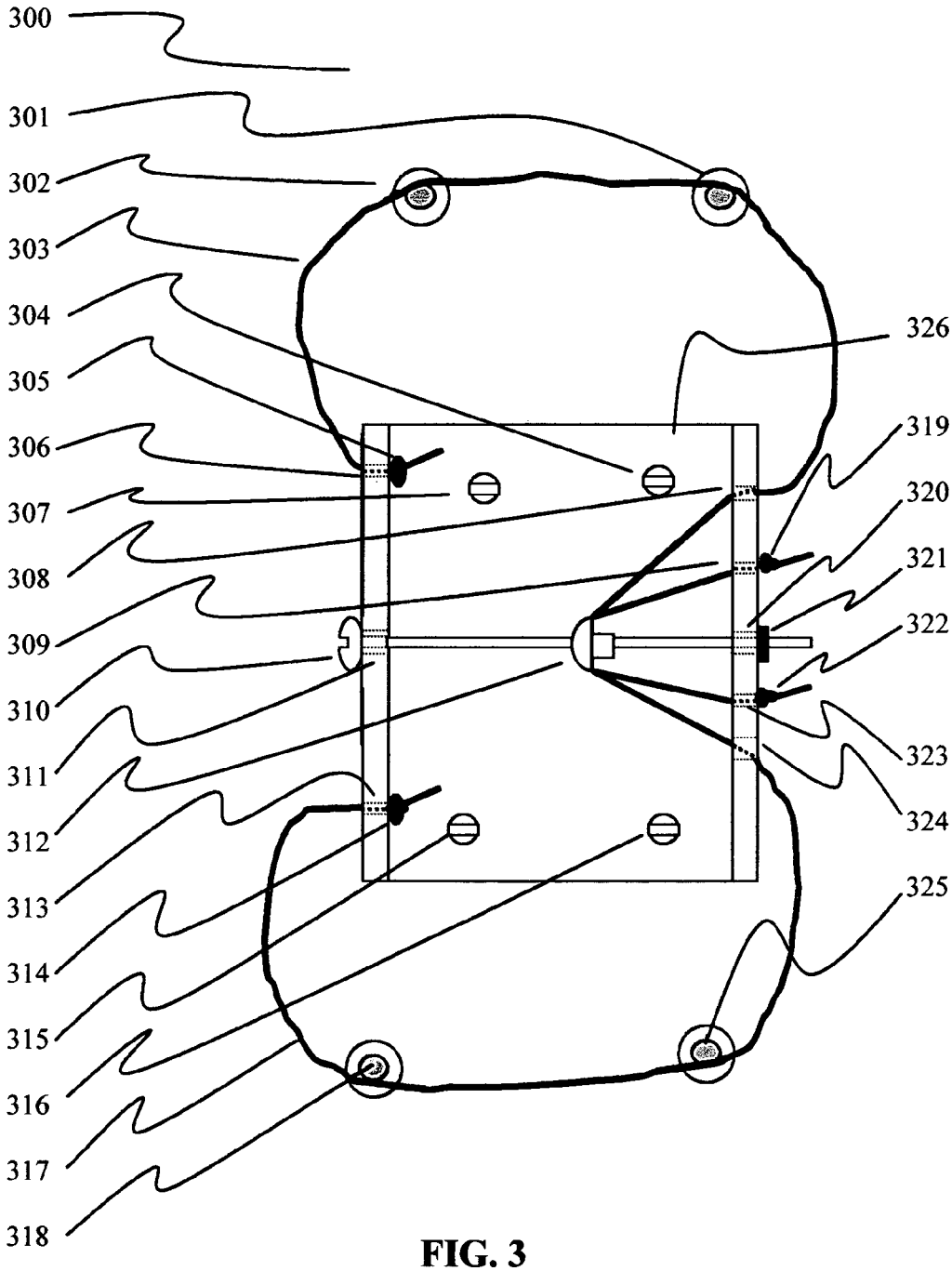
FIG. 3 is a front elevational view taken from the back surface of an object with four screw heads interfacing with a double loop hanger having one adjusting hook and fastened to the wall.

FIG. 3 shows hanger assembly from the back edge of an object having protruding screws 301, 302, 318 and 325 engaging cord loops 303 and 317 extending beyond the top and bottom of hanger body 326. The hanger body 326 is affixed to a surface with screws 304,307, 315 and 316. The hanger body is made from a U-channel and has apertures 311 and 320 through which screw 310 goes. Screw 310 has hook 312 threadably engaged to it and is held in position by retainer 321. Top cord 303 is knotted at 305 and goes through apertures 306, 308, and 323. It forms a top loop between 306 and 308 that goes over screws 301 and 302. Cord 303 then enters the body through aperture 308 and goes over hook 312 and then out through aperture 323 where it is knotted at 322. The bottom cord 317 forms a loop by being knotted at 314 and going through aperture 313, over screws 318 and 325, then into aperture 324. It then goes over hook 312 and exits the body at aperture 309 where it is knotted at 319.

Turning screw 310 simultaneously changes the length of the top and bottom loops. The top loop supports the object and the bottom loop locks the object onto the hanger.

Figure 4:
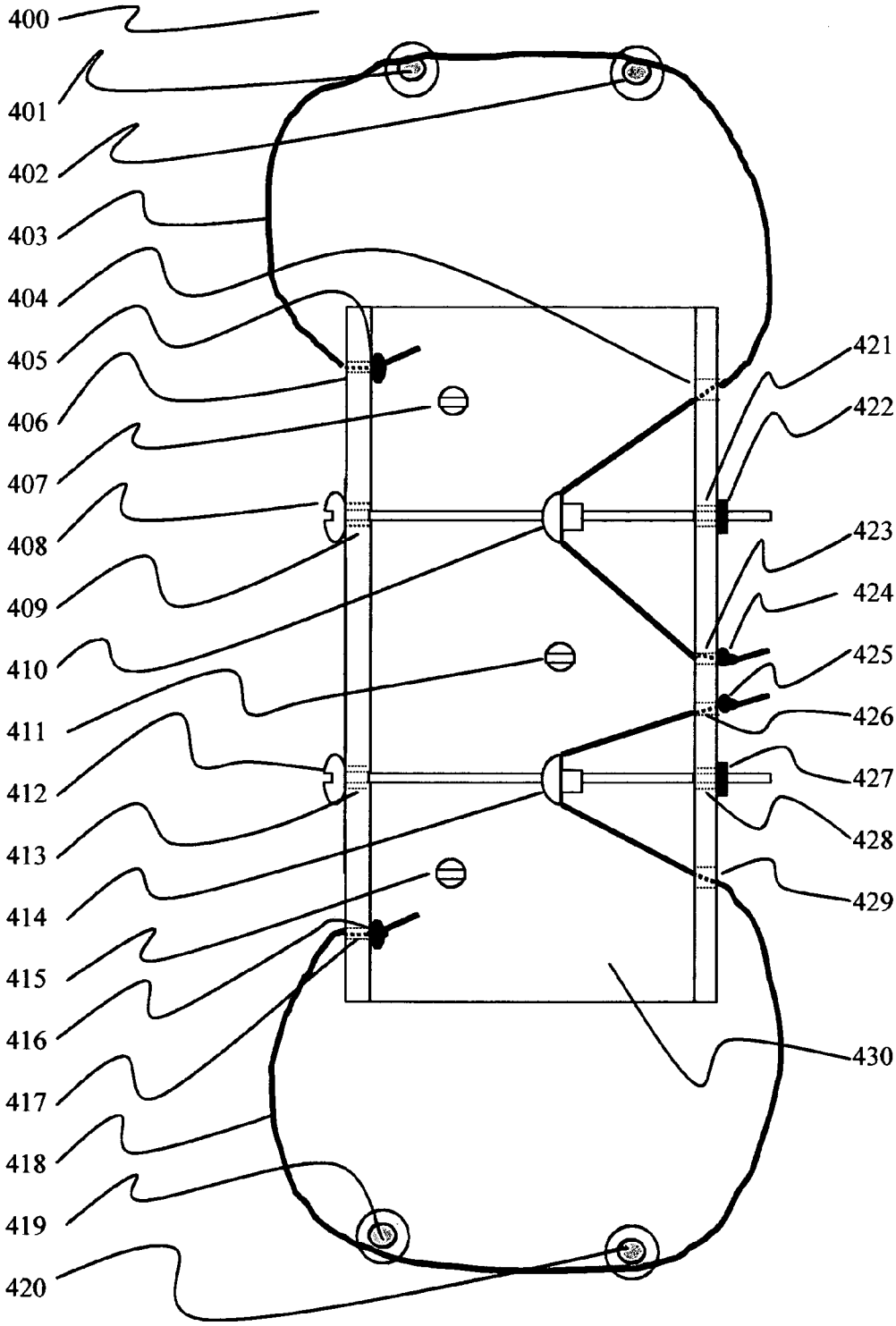
FIG. 4 is a front elevational view taken from the back surface of an object with four screw heads interfacing with a double loop hanger having two adjusting hooks and fastened to the wall.

FIG. 4 shows hanger assembly 400 having top cord 403 going over screws 401 and 402 that are protruding from the back of an object. The hanger body 430 is affixed to a surface with screws 407,411, and 415. The body has two screws and hooks. Top screw 408 goes through apertures 409 and 421. It has hook 410 threadably engaged on it and is retained by 422. Cord 403 is knotted at 405 and goes through apertures 406, 404, and 423. Between apertures 404 and 423 the cord goes over hook 410 and adjusts the length of the top loop as the screw 408 is turned and hook 410 moves on it. Bottom screw 412 goes through apertures 413 and 428. It is retained by 427 and has hook 414 threadably engaged on it. Bottom cord 418 starts at 416, goes through aperture 417, then over screws 419 and 420 that are protruding from the back of the object, and into aperture 429. From aperture 429 the cord goes over hook 414 and exits hanger body 430 at aperture 426 where it is knotted at 425.

Turning screw 412 changes the vertical position of the object by reducing the length of the bottom loop. Turning screw 408 changes the length of the top loop and initially alters the amount of top lean the object has with respect to a vertical surface until the cord is tightened against screws 401 and 402. The combined action of the two loops is to provide support, positioning and locking capability.

While the invention has been illustrated and described in the above specification it is not intended to be limited to the details shown, since it will be understood that various omissions, modifications, substitutions, and changes in the form and details of the devices illustrated can be made by those skilled in the art without departing from the spirit of the present invention. For instance, the hangers can be affixed to the object and the loops engage supports affixed to a surface; the hangers can be affixed to the middle of small objects or one on each side for larger objects; and the cords can also have a number of hooks going over them or on them for holding the object onto the hanger.

What I claim is:

1. A hanging system for picture, mirrors and other similar objects having;

A. a support body adapted to be fixed to a wall, said support body having two vertical side lips and open top and bottom edges;

B. a cord affixed to the lip of said support body on a first end and forming a loop by going through an aperture in said support body and a second end being affixed to said other lip adjacent said bottom edge of said support body;

C. a horizontal adjusting means for adjusting the vertical position of said cord;

D. wherein the downward extending cord engages a double beveled bracket affixed to said object and is configured to engage said support body, the double beveled bracket thereby supports and locks said object onto said hanging system.

2. The system of claim 1 wherein the hanger body is composed of a U-shaped channel and the horizontal means of adjusting the loop is composed of a hook traveling on a horizontal screw that is rotatably affixed to the hanger body by going through right and left apertures in the sides of the body.

3. The system of claim 1 wherein the loop is composed of a flexible cord affixed at one end to the top right side of the hanger body going around the hook and threaded back through apertures in the right side of the body and extending over to the left bottom side of the body, thereby forming a loop that is adjusted by the action of the hook on the screw.

4. A hanging system composed of a vertical hanger body configured to be affixed to a surface and having a horizontal means of adjusting downward and upward extending loops that engage top and bottom brackets affixed to an object, whereby said object is supported by the bottom loop and locked onto the hanger body by the top loop.

5. A hanging system composed of a vertical hanger body configured to be affixed to a surface and having a horizontal means of adjusting a downward extending loop and another horizontal means of adjusting an upward extending loop such that the loops engage top and bottom brackets affixed to an object, whereby said object is supported and positioned vertically by the bottom loop and locked onto the hanger body by the top loop.

6. The systems of claims 1, 4 & 5 wherein the hanger body is rotated and affixed to the object, and the bracket or brackets are affixed to the wall.

7. The systems of claims 1, 4 & 5 wherein right and left hanger bodies and brackets are used.

* * * * *